United States Patent [19]

Svirklys

[11] 4,078,515

[45] Mar. 14, 1978

[54] DOCK STRUCTURE

[75] Inventor: Ferdinand M. Svirklys, Toronto, Canada

[73] Assignee: Extrados Company Limited, Toronto, Canada

[21] Appl. No.: 784,955

[22] Filed: Apr. 6, 1977

[51] Int. Cl.[2] ..... B63B 35/00

[52] U.S. Cl. ..... 114/266; 61/48

[58] Field of Search ..... 114/266, 267; 61/48; 14/27

[56] References Cited

U.S. PATENT DOCUMENTS

| | | | |
|---|---|---|---|
| 3,073,274 | 1/1963 | Lamb | 114/266 |
| 3,102,503 | 9/1963 | Sheffield | 114/266 |
| 3,654,885 | 4/1972 | Godbersen | 114/266 |

*Primary Examiner*—Trygve M. Blix
*Assistant Examiner*—Stuart M. Goldstein
*Attorney, Agent, or Firm*—Sim & McBurney

[57] ABSTRACT

A readily assemblable and collapsible floating or standing dock is constructed of a plurality of transversely-extending elongate aluminum deck forming members releasably connected, through a simple interlocking fastening arrangement, to parallel elongate aluminum side rail members provided at each longitudinal side of the dock. Aluminum end rails are releasably interconnected between the side rail members to provide a rigid frame structure. An aluminum bumper rail extends along each longitudinal side of the dock with portions overlying the ends of the deck-forming members and portions releasably connected to the elongate aluminum side rail members.

16 Claims, 10 Drawing Figures

DOCK STRUCTURE

FIELD OF INVENTION

The present invention is directed to dock structures.

BACKGROUND TO THE INVENTION

Dock structures, particularly floating or standing docks for pleasure craft, conventionally are formed of wood and include a plurality of transversely-extending slats joined to depending parallel side rails and possibly one or more intermediate rails, depending on the width of the dock. The depending side rails are joined to one or more floats, in the case of a floating dock, or to pillars or uprights anchored on the river or lake bed in the case of a standing dock. End rails extending between the side rails also may be provided.

Wooden structures suffer from many disadvantages. In regions where the water body in which the dock is located freezes during the winter months, the dock must be removed from the water to prevent ice damage. Wooden structures are heavy, especially when waterlogged, making removal from the water a difficult operation, especially since the structure must be removed as a single unit.

Wooden structures also degrade rapidly under the exposure to weather and traffic and require replacement from time to time. Broken slats are difficult to replace effectively and to dispose of.

SUMMARY OF INVENTION

In accordance with the present invention, there is provided a dock structure which does not suffer the drawbacks of the prior art structures. The dock structure of this invention has the main structural parts formed of aluminum. The deck members are releasably connected to parallel elongate side rails connected to aluminum end rails, and an aluminum bumper rail having a bumper bar is releasably connected to the side rails. The structure is lightweight, virtually indestructible and may be readily assembled and readily disassembled for removal and storage.

DESCRIPTION OF PREFERRED EMBODIMENTS

Figure 1:
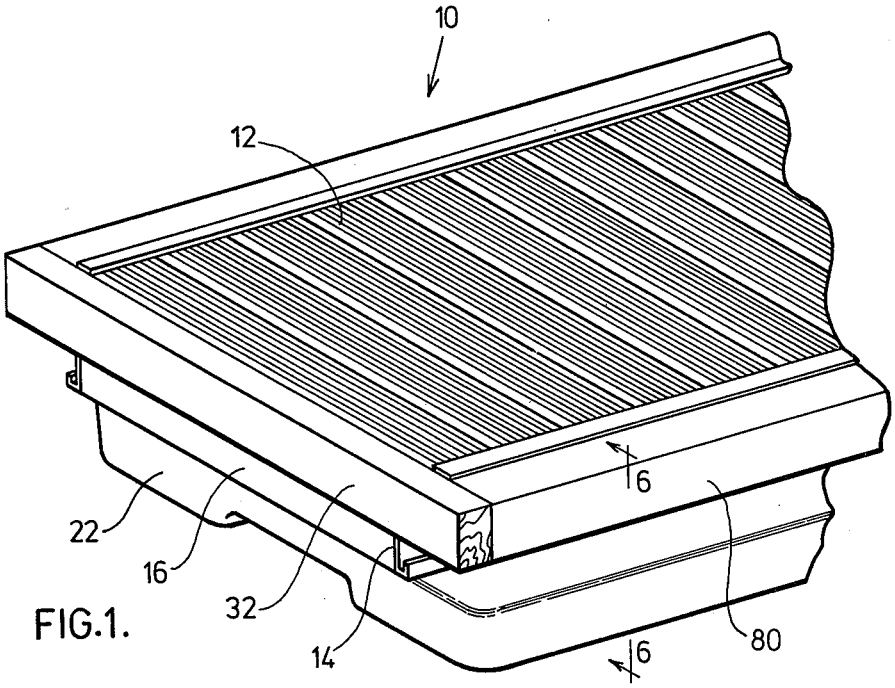
FIG. 1 is a perspective view of the end part of a dock structure in accordance with one embodiment of the invention provided in floating dock form.

Referring to the drawings, a dock structure 10 comprises a plurality of generally parallel deck members 12 constructed of aluminum releasably connected to a pair of parallel aluminum side rail members 14 extending generally perpendicularly to the deck members 12. Aluminum end rail members 16 extend between and generally perpendicular to the ends of the side rail members 14 and are connected thereto.

Figure 10:
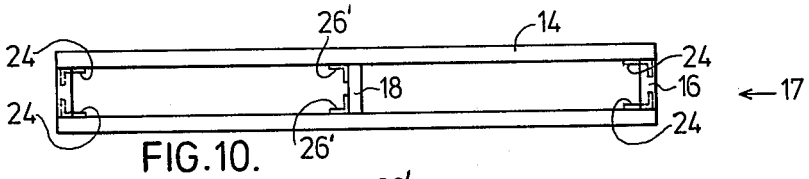
FIG. 10 is an alternative dock frame structure for use in a dock structure.
Figure 8:
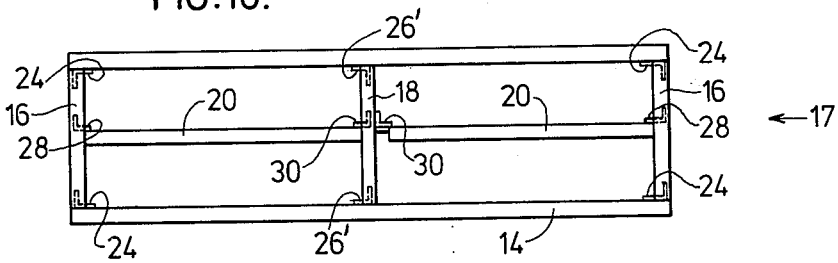
FIG. 8 is a plan view of the dock frame structure of the dock structure of FIG. 1.
Figure 9:
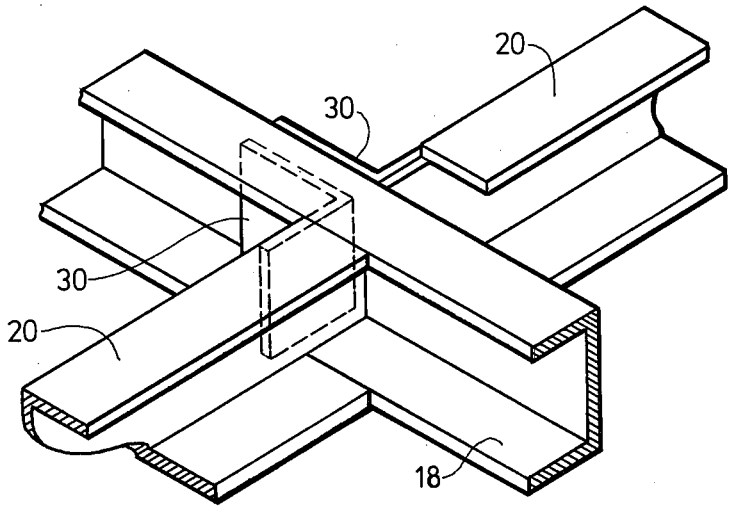
FIG. 9 is a perspective view of the interconnection of frame structure members in the structure of FIG. 8.
Figure 2:
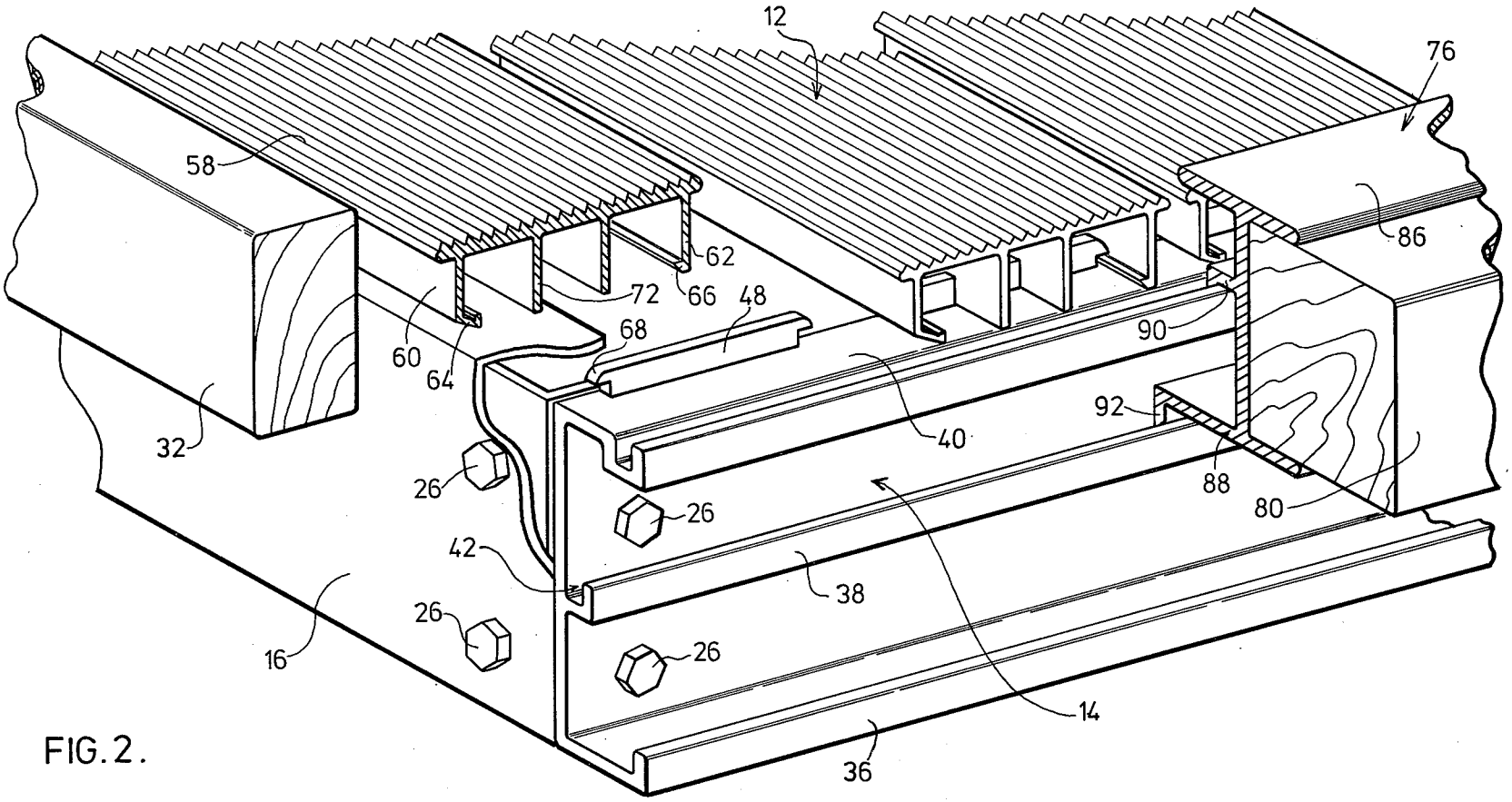
FIG. 2 is a perspective view, with parts cut away and exploded, showing details of the assembly of the dock of FIG. 1.

The dock frame 17 is completed by an aluminum rail member 18 extending between and connected to the side rail members 14 at the approximate midpoint along their length. In the frame structure of FIG. 8, additional aluminum rails 20 extend parallel to the side rails 14 and are connected between one end rail 16 and the center rail 18 to provide strength and rigidity to the frame 17. In dock frames 17 of lesser width, as shown in FIG. 10, the additional rails 20 may be omitted.

The dock frame 17 comprised of the rail members is rigid and is attached to one or more floats 22. The floats may be of any convenient form, for example, hollow plastic floats. If the dock 10 is a standing structure, the frame 17 is connected to pillars or ground anchors. The invention will be described particularly with reference to a floating dock structure.

Each side rail member 14 has a generally E-shaped cross-section opening outwardly of the dock frame 17 and each end rail member 16 is of generally flat-based C-shaped cross-section opening inwardly of the dock frame 17. Adjacent ends of the side rail members and the end rails 16 are rigidly joined by angle plates 24 which are bolted to both the side rail 14 and the end rail 16 by bolts 26.

The center rail 18 and the additional rails 20, if any, are also of flat-based C-shaped cross-section, but the upper and lower projections of the additional rails 20 are cut away adjacent their ends to allow for entry into the C-shaped cross-section of the end rails 16 and center rail 18.

The center rail 18 is connected at its ends to the side rails 14 by angle plates 26' which are bolted to both the side rail 14 and the center rail 18. The additional rails 20 are connected to the end rails 16 by angle plates 28 which are bolted to both the rails 16 and 20 and to center rail 18 by angle plates 30 which are bolted to both the rails 18 and 20.

Only one of the additional rails 20 need have the upper and lower projections cut away at both ends, while the other need have the projections cut away at the end connected to the end rail 16, since this rail 20 does not project into the opening of the center rail 18. However, for ease of manufacture and assembly, it is preferred to have both additional rails 20 identically constructed, as illustrated.

The aluminum rail members 14, 16, 18 and 20 may be conveniently formed by extrusion, although any desired manufacturing technique may be adopted.

Each end rail 16 has a bumper bar 32 connected thereto in any convenient manner. Usually the bumper bar 32 is of rectangular of square cross-section and constructed of wood, but any other convenient constructional material may be used.

Each side rail member 14 has a vertically-extending web 34 and three integrally-formed projections 36, 38 and 40 therefrom. The projection 36 extends horizontally from the lower end of the web 34 and engages the upper surface of the float 22.

The projection 38 is L-shaped and forms an upwardly-opening channel 42 with the web 34. The projection 40 includes a horizontally-extending portion 44 and an upwardly-opening channel-defining portion 46 at the end of the portion 44 remote from the web 34. The purpose of the channels 42 and 46 will become apparent hereinafter.

The horizontally-extending portion 44 has a plurality of upwardly-extending integrally-formed laterally-thin and longitudinally-extending protrusions 48 equally spaced along the length of each side rail member 14 and equal in number to the number of the deck members 12.

Each of the protrusions 48 is undercut at its ends to define therein shoulders 50 and 52 respectively and undercuts 54 and 56 respectively. While the structure is illustrated with one protrusion 48 at each end for each deck member 12, a plurality of such protrusions 48 may be provided for each deck member 12, for greater strength or rigidity.

Each deck member 12 has a continuous planar surface 58, preferably provided with a non-slip outer surface, which cooperates with other like surfaces to form a planar deck surface to the dock 10. Integral skirt portions 60 and 62 depend from adjacent the lateral sides of the planar surface 58 generally perpendicularly thereto.

At the lower end of each skirt portion 60 and 62 is a shoulder-engaging member 64 and 66 respectively. Each shoulder-engaging member includes a portion projecting inwardly of the skirt 60 or 62 towards the other and a shoulder face-engaging portion. Generally, the shoulder-engaging member 64 projects inwardly a greater distance than the shoulder-engaging member 66 and a distance substantially equal to the depth of the undercut 54.

Figure 4:
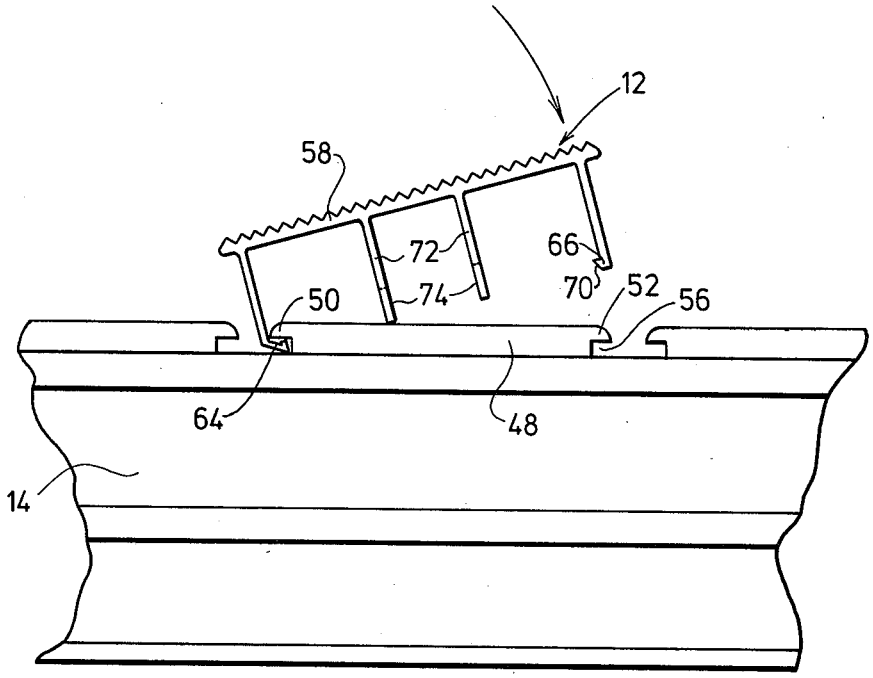
FIGS. 4 and 5 are end views of the connection of a deck member to a side rail.
Figure 5:
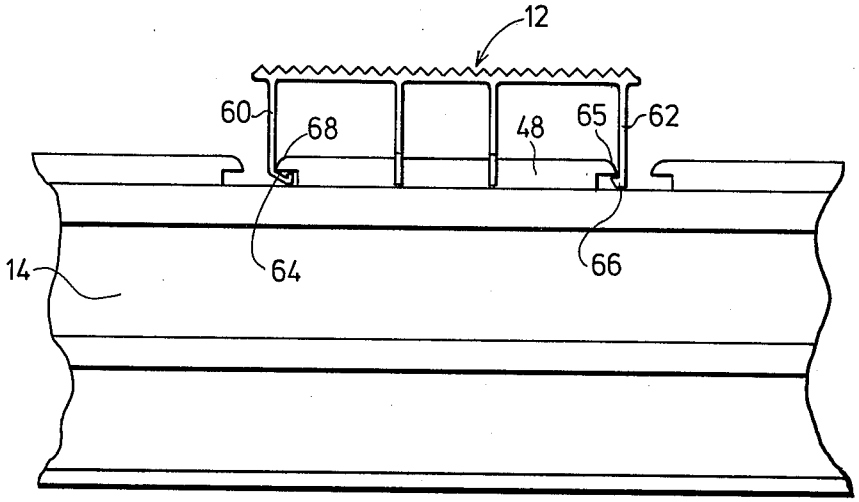

While the undercuts 54 and 56 have the dimensions and depth approximately equal to the extremity of the shoulder-engaging member 64, this arrangement is for convenience in assembly of the dock 10, allowing the longer shoulder-engaging member 64 to be inserted in either undercut 54 and 56 to engage both the shoulder and end wall of the undercut, so that the arrangement shown in FIGS. 4 and 5 with respect to the relative positions of the shoulder-engaging members 64 and 66, may be attained.

However, if desired, the undercuts 54 and 56 may be dimensioned such that the undercut 54 has a depth at least equal to the maximum distance of extension of the shoulder-engaging member 64 and the undercut 56 has a lesser depth at least equal to the maximum distance of extension of the shoulder-engaging member 66.

Each shoulder 50 and 52 has a sloping outer surface 68 while the surface of the shoulder-engaging member 66 intended to engage the sloping surfaces 58 during assembly, as described below, is bevelled at 70.

The deck members 12 also include a pair of webs 72 depending from the planar surface 58 parallel to the skirt portions 60 and 62 for engagement with the horizontally-extending portion 44. A single such web 72 may be used, if desired, although it is preferred to provide the pair of such webs for strength and stability. Greater numbers of such webs 72 may be used, if desired.

Slots 74 are provided in each of the webs 72 for receiving the protrusion 48 therein. The interaction of the protrusion 48 with the slots 74 constitutes stop means and prevent longitudinal displacement of the deck members 12 relative to the side rails 14 in an assembled dock. In this way, a stable assembly is achieved.

Each deck member 12 has a thickness and size allowing limited flexibility when bent along along its longitudinal center line. This flexibility, the dimensioning of the deck members 12, the dimensioning and shape of the protrusions 48 and the dimensioning of the shoulder-engaging members 64 and 66 combine to provide snap-fit means, readily releasably interlocking the deck members 12 to the side rails 14. The interlocking and releasing of the deck members 12 and side rails 14 is achievable without the use of special tools or skills.

Figure 3:
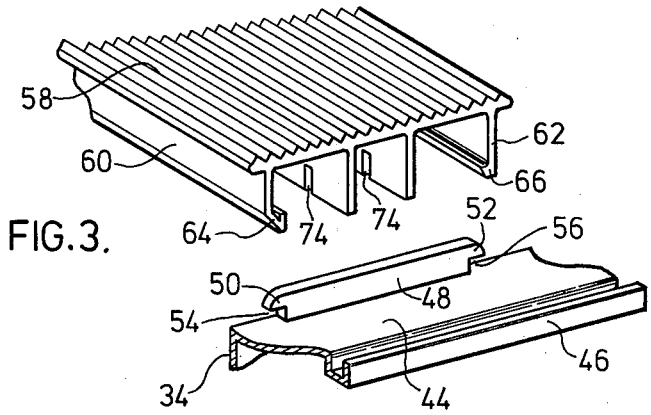
FIG. 3 is a detail perspective view of one deck member and connector therefor.

As seen particularly in FIGS. 3 to 5, the deck members 12 are assembled with the side rails 14 at each intersection thereof by inserting the longer shoulder-engaging member 64 into the undercut 54 and pushing the shorter shoulder-engaging member 66 against the upper and outer surface of the shoulder 52, causing the deck member 12 to flex slightly about its center line, thereby moving the shoulder-engaging members 64 and 66 a greater distance apart, so that the bevelled surface 70 of the shoulder-engaging member 66 rides on and round the surface 68 of shoulder 52 and snap fits into the undercut 56 in engagement with the underside of the shoulder 52. At the same time, the protrusions 18 extend into the slots 74.

Disassembly of the interlock is readily achieved by flexing the member 12 about its center line until the shoulder-engaging members 64 and 66 are spaced apart a distance sufficient to remove the shoulder-engaging member 66 from the undercut 56.

The disassembly of the deck members 12 and side rails 14 is not prevented by the stop means constituted by the interaction of the protrusion 48 with slots 74.

If desired, the additional rails 20 may be provided with one or more protrusions 48 with the webs 72 being provided with appropriate slots 74 for releasable interconnection of the deck members 12 to the additional rails 20 at their intersections to increase the rigidity and strength of the overall structure.

Additionally, while the protrusions 48 are shown as a single integral member, the protrusions may be formed in discontinuous manner, typically having three separate parts, one at each end having the undercuts therein and a central tab for projection into the slot 74.

The dock 10 also is provided with a pair of side bumper rails 76 releasably connected one to each side rail 14. Each bumper rail 76 comprises an elongate aluminum member 78, which generally is formed by extrusion having a generally E-shaped cross-section opening towards the side rail 14 and a generally flat-based C-shaped cross-section opening away from the side rail 14. A bumper bar 80 of any convenient material, such as wood, plastic or rubber, having a suitable cross-section, such as the generally rectangular or square cross-section illustrated or a part-circular cross-section, is received in the U-shaped cross-section opening of the elongate member 78 and secured therein, such as, by securing screws 82.

The elongate member 78 includes a vertically-extending web 84 and integrally-formed projections 86, 88 and 90. The projection 86 extends horizontally on both sides of the web 84 perpendicularly thereto. The projection 88 extends horizontally on both sides of the web 84 perpendicularly thereto and also includes a depending skirt portion 92 at the end of the projection 88 remote from the web 84 and closest to the side rail 14. The projection 90 is L-shaped and forms a downwardly-opening channel 94 with the web 84.

In the assembled dock 10, the downwardly-opening channel 94 of the bumper rail 76 interengages with the upwardly-opening channel 46 of the side rail member 14 and the downwardly-depending skirt member 92 of the bumper rail 76 projects into the upwardly-opening channel 42, resulting in releasable assembly of the bumper rail 76 with the side rail 14. Temporary securement of the bumper rail 76 to the side rail 14 to prevent accidential dislodgement of the bumper rail 76 may be achieved using self-tapping screws 96, or any other convenient fixing means.

Figure 6:
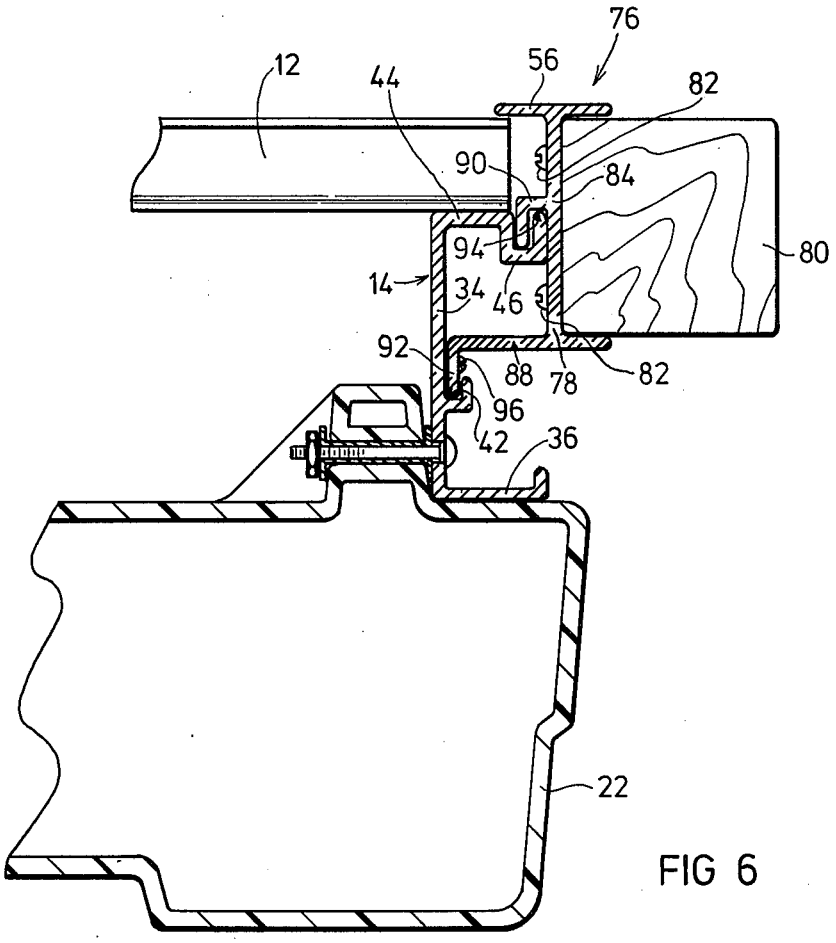
FIG. 6 is a sectional view taken on line 6—6 of FIG. 1.
Figure 7:
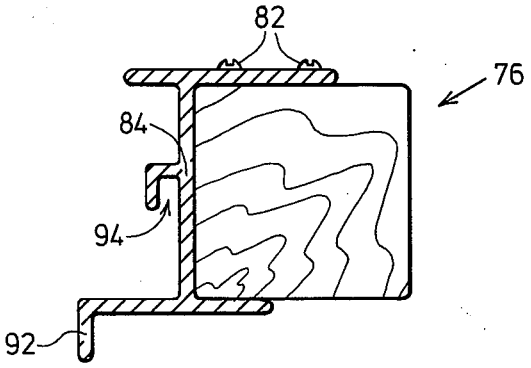
FIG. 7 is a sectional view of an alternative bumper rail structure.

The portion of the projection 86 extending towards the side rail 14 overlaps the ends of the deck members 12, as shown in FIG. 6, to provide an aesthetic assembly. As seen in FIG. 1, the bumper bar 32 attached to the end rails 16 extends beyond the ends of the end rails 16 to overlap the ends of the bumper bar 80.

The dock structure 10 of the present invention, suitable for assembly with floats 22 to form a floating dock, is comprised of a rigid aluminum frame 17, deck members 12 and aluminum bumper rails. The only wooden parts of the structure are the bumper bars 32 and 80 which are only a minor portion of the overall structure, and may be replaced by other materials, such as, vinyl or rubber, if desired.

The dock structure 10 possesses many advantages over conventional wooden dock structures. Thus, the structure may be assembled without special tools and skills and may be disassembled readily for removal from water bodies during freeze up, in contrast to wooden structures.

The aluminum is not readily corrodible or damaged by exposure to the elements and hence does not need replacement for many years in contrast to the wooden structures, does not absorb water and hence remains light in weight, easing removal from the water body, is inflammable and very durable. Any worn or broken parts have scrap value as aluminum and hence are 100% recyclable, in contrast to the difficulties of disposal of broken wooden parts. Repairs can be readily effected, owing to ease of disassembly of the parts.

SUMMARY

The present invention, therefore, provides a dock structure which has considerable advantages over the prior art wooden structures. Modifications are possible within the scope of the invention.

What I claim is:

1. A dock structure, comprising:

a pair of laterally spaced-apart substantially-parallel longitudinally-extending aluminum side rails;

a plurality of deck-forming aluminum members contacting and extending between said pair of side rails generally transverse thereto in spaced apart relation, each of said plurality of deck-forming members having at least one planar portion cooperating with the at least one planar portion of the others of said plurality of deck-forming members to provide a planar top surface which extends substantially the length of the side rails;

snap fit means releasably interconnecting said side rails with each of said plurality of deck-forming members at the intersections thereof, at each said intersection, said snap fit means including a first part integral with said side rail and a second cooperating part integral with said deck-forming member;

stop means located at each said intersection and preventing movement of each of said plurality of deck-forming members longitudinally thereof and transverse to said side rails while normally permitting movement of said pluralaity of deck-forming members out of contact with said side rails upon release of said snap fit means to allow disassembly of said dock structure, said stop means at each said intersection including cooperating elements integral with said side rail and integral with said deck-forming member; and a pair of aluminum bumper rails extending along each longitudinal side of the dock externally of said side rails and releasably connected thereto.

2. The dock structure of claim 1, wherein each of said plurality of deck-forming members includes a wholly planar portion spaced from said side rails at said intersections and spacer means depending from said planar portion into engagement with said side rails at said intersection.

3. The dock structure of claim 2, wherein each of said plurality of deck-forming members further includes first and second skirt members depending one from adjacent each lateral extremity of said planar portion, and said spacer means comprises a pair of webs depending from said planar portion parallel to each other and to said skirt members.

4. The dock structure of claim 3, including at least one vertical slot formed in each said web at each said intersection to constitute said cooperating element of said stop means integral with said deck-forming member and for receiving a protrusion integral with said side rails and constituting said cooperating element integral with said side rail.

5. The dock structure of claim 4, wherein said snap fit means comprises at least one continuous elongate protrusion extending from the side rail and in the direction of extension thereof, said continuous elongate protrusion including shoulders projecting in opposite directions generally parallel to and spaced from the adjacent surface of the side rail to define an undercut therewith and a generally central portion constituting said received protrusion and said snap fit means further including undercut-engaging members formed on each of said deck-forming members constructed to snap fit into said undercuts.

6. The dock structure of claim 1 including a pair of laterally spaced-apart longitudinally-extending aluminum end rails extending between and releasably connected to the side rails, said end rails and said side rails defining a substantially rigid rectangular frame structure.

7. The dock structure of claim 6, wherein said bumper rails and said end rails have bumper bars secured thereto around the periphery of the frame structure.

8. The dock structure of claim 6, wherein each of said side rails includes a vertically-extending web having an integrally-formed horizontally-extending member provided at the upper end thereof extending away from said frame structure and each of said end rails is of generally flat-based C-shaped cross-section opening inwardly of the frame structure.

9. The dock structure of claim 8, wherein each of said side rails further includes a first upwardly-opening channel member integrally formed at the end of said horizontally-extending member and a generally L-shaped cross-sectioned projection spaced vertically downwardly from said horizontally-extending member and defining with the web a second upwardly-opening channel, and each of said bumper rails includes a pair of downwardly-depending projections received one in each of said upwardly-opening channels to constitute said releasable connection between said side rails and said bumper rails.

10. The dock structure of claim 9, including means for temporarily preventing separation of said side rails and bumper rails.

11. The dock structure of claim 9, wherein each of said bumper rails includes a vertically-extending web having an integrally-formed horizontally-extending member provided at the lower end thereof extending towards the adjacent side rail and a first depending skirt member extending into said second upwardly-opening channel as said depending projection received therein, and a generally L-shaped cross-section projection spaced vertically upwardly from said last-mentioned horizontally-extending member and defining with said web a downwardly-opening channel interengaging with said first upwardly-opening channel and including said depending projection received therein.

12. The dock structure of claim 11, wherein each of said bumper rails also includes a second integrally-formed horizontally-extending member provided at the upper end of said web extending towards the adjacent side rail and overlapping the ends of said deck-forming members.

13. The dock structure of claim 12, wherein each of said bumper rails also includes integrally-formed third and fourth horizontally-extending members provided at the upper and lower ends of said web and extending away from the adjacent side rails and a generally rectangularly cross-sectioned elongate bumper bar engaging the web and the inner surface of the third and fourth horizontally-extending members and secured to the bumper rail.

14. The dock structure of claim 12, wherein each of said side rails includes a second horizontally-extending member at the lower end of said web and including at least one float member secured to said webs of said side rail members and in engagement with said last-mentioned second horizontally-extending member.

15. The dock structure of claim 6, wherein said frame structure also includes at least one additional aluminum lateral rail member extending between the side rails and releasably secured thereto.

16. The dock structure of claim 15, wherein said frame structure also includes at least one additional aluminum longitudinal rail member extending between the end rails and said at least one additional lateral member and secured thereto.

* * * * *